United States Patent [19]

Barten

[11] 3,973,159

[45] Aug. 3, 1976

[54] CATHODE-RAY TUBE FOR DISPLAYING COLORED PICTURES

[75] Inventor: Piet Gerard Joseph Barten, Eindhoven, Netherlands

[73] Assignee: U.S. Philips Corporation, New York, N.Y.

[22] Filed: Jan. 22, 1974

[21] Appl. No.: 435,531

[30] Foreign Application Priority Data

Feb. 21, 1973 Netherlands ..... 7302367

[52] U.S. Cl. ..... 313/403

[51] Int. Cl.[2] ..... H01J 29/07; H01J 31/20

[58] Field of Search ..... 313/85 S

[56] References Cited

UNITED STATES PATENTS 3,731,129 5/1973 Tsuneta et al. ..... 313/85 S X

FOREIGN PATENTS OR APPLICATIONS 2,012,046 10/1970 Germany ..... 313/85 S

*Primary Examiner*—Robert Segal

*Attorney, Agent, or Firm*—Frank R. Trifari; George B. Berka

[57] ABSTRACT

A color cathode-ray tube having a shadow mask comprising parallel rows of rectangular apertures. The rows of apertures are staggered relative to each other in n steps so as to reduce Moire patterns; the intermediate distance between the apertures in the direction of the rows is chosen to be equal to p/n, where p is the pitch in the direction of the rows between the apertures.

1 Claim, 2 Drawing Figures

CATHODE-RAY TUBE FOR DISPLAYING COLORED PICTURES

The invention relates to a cathode-ray tube for displaying coloured pictures comprising, in an evacuated envelope, means to produce at least two electron beams, a display screen comprising at least two patterns of regions luminescing in different colours, and a colour selection electrode comprising a large number of substantially rectangular apertures which are arranged in substantially parallel rows, said apertures, measures in the direction of the rows, having substantially the same length *a* and substantially the same mutual pitch *p*, said rows being provided so as to be staggered relative to each other over a distance equal to an integer number of times p/n, *n* being an integer equal to or larger than 2.

Such a cathode-ray tube is known from the German published Patent Application No. 2,012,046. Said Patent Application states means to reduce moire patterns which means consist of the provision of the apertures in the various rows that they are staggered relative to each other. Moire patterns are bright and dark bands which arise in the displayed picture by interference of the lines of the frame of which the picture is built up with the pattern of the apertures in the colour selection electrode. Both the lines of the frame and the pattern of the apertures show a certain periodicity by which the occurrence of the bright and dark bands by interference can simply be explained.

It is the object of the invention to check the occurrence of the said moire patterns substantially entirely. For that purpose a cathode-ray tube according to the invention is characterized in that *p-a* is substantially equal to p/n.

As will become apparent hereinafter, the average transmission of the pattern of the apertures in the shadow mask with this choice of *p-a*, that is to say, of the size of the bridges between the apertures, shows no periodicity in the direction of the rows of apertures. As a result of this no moire patterns can be formed with bright and dark bands perpendicular to the direction of the rows of apertures.

Figure 1:
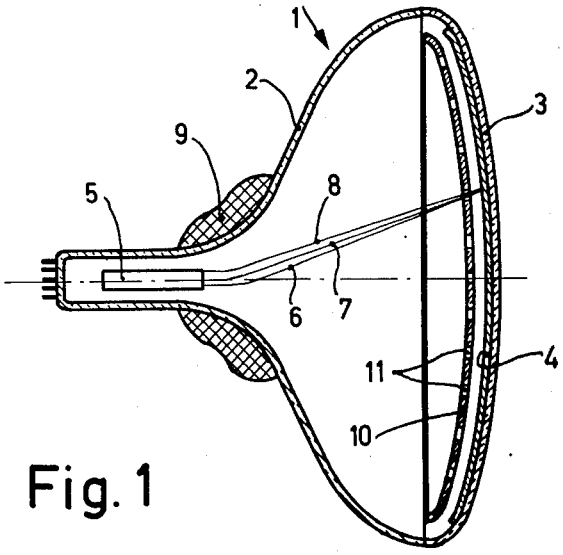
Figure 2:
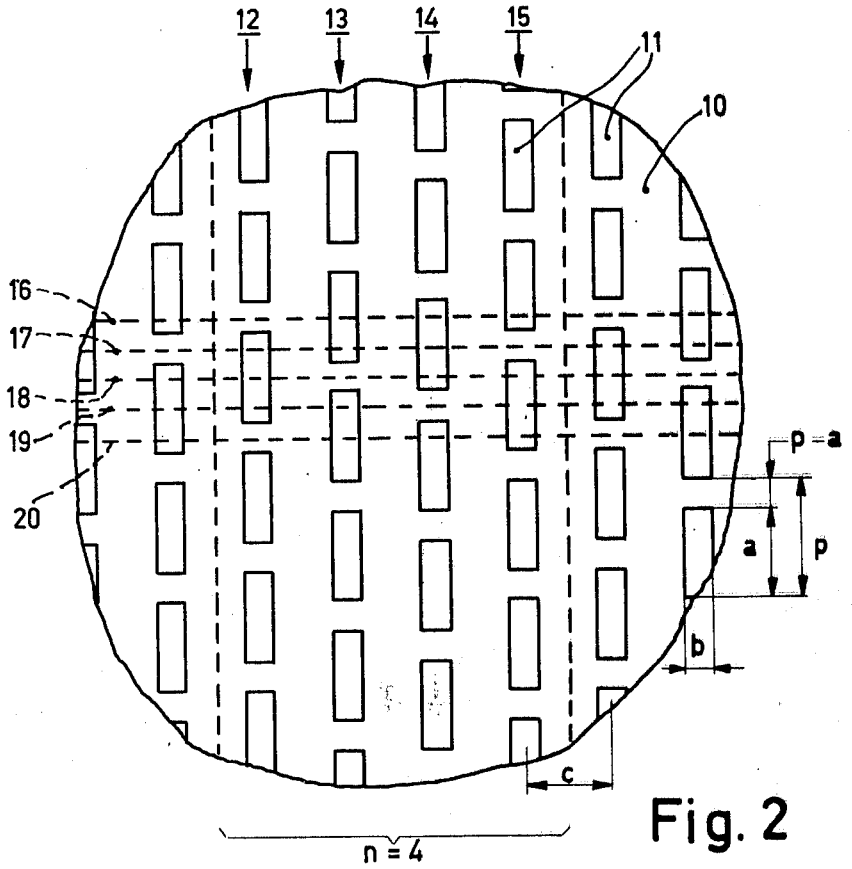

The invention will be described in greater detail with reference to the accompanying drawing, of which FIG. 1 shows a cathode-ray tube according to the invention and FIG. 2 shows a part of the pattern of apertures in the colour selection electrode of the tube shown in FIG. 1.

FIG. 1 shows a colour television display tube having a glass envelope 1 comprising a conical portion 2 and a face plate 3. A display screen 4 comprising discrete regions of phosphors luminescing in different colours (red, green and blue) is provided on the face plate 3. The tube comprises an electron gun 5 for generating three electron beams 6, 7 and 8 which are deflected over the display screen 4 by the deflection coils 9. The tube furthermore comprises a colour selection electrode 10, sometimes referred to as shadow mask, having a large number of apertures 11. The apertures 11 ensure that the electron beam 6 impinges only on red phosphor regions and the electron beams 7 and 8 only on green and blue phosphor regions, respectively. In the non-deflected condition, the three electron beams 6, 7 and 8 are in one plane, namely the plane of the drawing of FIG. 1. The phosphor regions consist of juxtaposed phosphor strips having their longitudinal direction perpendicular to the plane of the drawing. Such a colour television display tube is known from the prior art and needs no further explanation.

FIG. 2 shows a part of the colour selection electrode 10. The apertures 11 are arranged in rows of which a few are denoted by 12, 13, 14 and 15. The longitudinal direction of said rows is parallel to the longitudinal direction of the phosphor strips of the display screen 4 and is vertical in normal operation of the tube. The apertures 11 in the various rows are provided so as to be staggered relative to each other. As shown in FIG. 2, the rows of apertures can be divided into groups of 4 different juxtaposed rows. So in the embodiment shown, $n=4$. The length of the apertures 11 is denoted by *a* and is 0.66 mm, the width *b* is 0.14 mm and the pitch *p* is 0.88 mm. The distance *c* between the rows is 0.66 mm. The rows of apertures are staggered relative to each other once, twice or three times p/4 mm as is also known from the already mentioned German Pat. Application No. 2,012,046.

The staggering is divided irregularly over the rows so as to also prevent the occurrence of moire bands in directions other than perpendicular to the rows of apertures. The staggering of row 13 relative to row 12 is $2p/4$, the staggering of row 14 relative to row 12 is $3p/4$ and the staggering of row 15 relative to row 12 is p/4. This pattern is always repeated.

According to the invention, the width *p-a* of the bridges between the apertures in one row is equal to p/n, so in the embodiment shown equal to $p/4 = 0.22$ mm. This has for its result that any imaginary line perpendicular to the rows of apertures, for example, the broken lines 16, 17, 18, 19 or 20 of each group of 4 rows always crosses exactly three apertures. From this it follows that the transmission of the colour selection electrode 10 integrated over said line remains substantially constant when shifting said line in the direction parallel to the rows so that the occurrence of moire bands perpendicular to said rows is suppressed substantially entirely. The already mentioned, known, irregular staggering of the rows suppresses the occurrence of moire bands in other directions.

What is claimed is:

1. A cathode-ray tube for displaying coloured pictures comprising, in an evacuated envelope, means to produce at least two electron beams, a display screen comprising at least two patterns of regions luminescing in different colours, and a colour selection electrode comprising a plurality of substantially rectangular apertures which are arranged in substantially parallel rows, said apertures, measured in the direction of the rows, having substantially the same length a and substantially the same mutual pitch p, said rows being staggered relative to each other in n uniform steps over a distance equal to an integer number times p/n, n being an integer equal to or larger than 2, and the distance p-a between two apertures in a row being substantially equal to p/n.

* * * * *